US010931003B2

(12) United States Patent
Berioli et al.

(10) Patent No.: US 10,931,003 B2
(45) Date of Patent: Feb. 23, 2021

(54) ANTENNA WITH MODULAR RADIATING ELEMENTS

(71) Applicant: Systems and Software Enterprises, LLC, Brea, CA (US)

(72) Inventors: Matteo Berioli, Munich (DE); Peter Lewalter, Lorch (DE)

( * ) Notice: Subject to any disclaimer, the term of this patent is extended or adjusted under 35 U.S.C. 154(b) by 45 days.

(21) Appl. No.: 16/398,807

(22) Filed: Apr. 30, 2019

(65) Prior Publication Data

US 2019/0348755 A1 Nov. 14, 2019

Related U.S. Application Data

(60) Provisional application No. 62/668,550, filed on May 8, 2018.

(51) Int. Cl.
*H01Q 1/36* (2006.01)
*H01Q 1/28* (2006.01)

(52) U.S. Cl.
CPC ..... *H01Q 1/36* (2013.01); *H01Q 1/28* (2013.01)

(58) Field of Classification Search
None
See application file for complete search history.

(56) References Cited

U.S. PATENT DOCUMENTS

| | | | | |
|---|---|---|---|---|
| 7,715,783 | B2 | 5/2010 | Girard et al. | |
| 8,334,809 | B2 | 12/2012 | Nichols et al. | |
| 9,316,099 | B2 | 4/2016 | Baxter et al. | |
| 9,337,536 | B1 | 5/2016 | Paulsen et al. | |
| 9,647,345 | B2 | 5/2017 | Hyde et al. | |
| 9,793,596 | B2 | 10/2017 | Hyde et al. | |
| 9,923,271 | B2 | 3/2018 | Hyde et al. | |
| 10,079,431 | B2 | 9/2018 | Deng et al. | |
| 2004/0174299 | A1 | 9/2004 | Casas et al. | |
| 2005/0212715 | A1 | 9/2005 | Saunders | |
| 2009/0021437 | A1* | 1/2009 | Foo | H01Q 1/246 343/761 |
| 2009/0034475 | A1 | 2/2009 | Runyon et al. | |
| 2016/0181687 | A1 | 6/2016 | Baxter et al. | |
| 2018/0054251 | A1 | 2/2018 | Alex | |

FOREIGN PATENT DOCUMENTS

| | | | |
|---|---|---|---|
| EP | 1842265 | B1 | 11/2017 |
| WO | 2016196057 | A1 | 12/2016 |

OTHER PUBLICATIONS

European Patent Office. International Search Report and Written Opinion, dated Jul. 25, 2019.

* cited by examiner

*Primary Examiner* — Jany Richardson
(74) *Attorney, Agent, or Firm* — Umberg Zipser LLP

(57) ABSTRACT

Telecommunication systems for aircraft and other vehicles are described having one or more antennas with a plurality of modular, radiating elements disposed about and coupled to a central element. Each of the plurality of modular, radiating elements comprises transmitting and receiving elements. The antenna may be mounted to an adapter plate along with another antenna of similar construct.

14 Claims, 11 Drawing Sheets

ANTENNA WITH MODULAR RADIATING ELEMENTS

This application claims priority to U.S. provisional application having Ser. No. 62/668,550 filed on May 8, 2018. This and all other referenced extrinsic materials are incorporated herein by reference in their entirety. Where a definition or use of a term in a reference that is incorporated by reference is inconsistent or contrary to the definition of that term provided herein, the definition of that term provided herein is deemed to be controlling.

FIELD OF THE INVENTION

The field of the invention is antennas for avionic use, more specifically antennas utilized in satellite communications.

BACKGROUND

The following description includes information that may be useful in understanding the present invention. It is not an admission that any of the information provided herein is prior art or relevant to the presently claimed invention, or that any publication specifically or implicitly referenced is prior art.

The provisioning of an aircraft with the ability to link to satellite communication networks necessarily entails the use of antenna, which is generally external to the aircraft. Unlike ground-based or maritime craft, however, the need to provide a suitably aerodynamic profile sets limitations on the size and configuration of such antenna, which can limit the antenna's performance.

One antenna configuration currently in avionic use is a rectangular antenna that lies along or is angled relative to the aircraft's surface (type 1). Such an antenna is steered mechanically to adjust azimuth. Similarly, elevation is adjusted mechanically. Such antennas are commercially available through various companies such as Honeywell™, Zodiac Data Systems™, Astronics™, Gilat™, and Viasat™. An example of a type 1 antenna is shown in FIG. 1.

Another antenna configuration currently in avionic use is a fixed antenna that lies along the aircraft's surface, generally having a circular shape that is steered electronically in both azimuth and elevation (type 2). Such antennas are commercially available through Thinkom™, Phasor™, Quest™, and Rockwell Collins™, for example. An example of a type 2 antenna is shown in FIG. 2.

Generally, a type 1 antenna has a higher antenna profile (d) than a comparable type 2 antenna, which is undesirable from an aerodynamic standpoint. There are, however, important differences in performance characteristics.

An important factor in the suitability of the performance of such antennas is their performance at different latitudes, as communications satellites are generally placed in equatorial orbits (i.e. 0° latitude). This is largely a function of the antenna gain. Antenna gain can be understood as the power flux of a signal intercepted by the effective aperture ($A_e(\varepsilon)$) in a specified direction. Generally, at a given elevation angle ε, gain ($G(\varepsilon)$) can be calculated using the following formula:

$$G(\varepsilon)=\eta(4\pi A_e(\varepsilon)/\lambda^2)$$

For a type 1 antennas, $A_e$ (ε) is effectively the area of the rectangular antenna surface (A1). For a type 2 antennas, $A_e$ (ε) is the area of the antenna surface multiplied by the sine of the elevation angle (i.e. A2*sin(ε)). As a result, all other factors (e.g., efficiency, frequency, footprint, etc.) being equal, the gain of a type 1 antenna remains constant at different elevation angles while the gain of a type 2 antenna is sharply reduced at low elevation angles (see FIG. 3).

Consequently, an antenna of type 1 configuration would be expected to support satellite communication over a broader range of latitudes than an antenna with a type 2 configuration having a similar footprint. Such type 1 antennas, however, have a skew angle issue resulting from beam asymmetry that limits their use at longitudes far from the target satellite (due to interference to neighboring satellites). Antennas having a type 2 configuration have less of a skew angle issue; however, this reduction in interference to neighboring satellites is accompanied by reduced gain at higher latitudes. Potential service coverages of a type 1 and type 2 antenna are shown in FIG. 4, where the satellite longitude is assumed to be 0° and the coverage $\varepsilon_{min}$=0° for the type 1 antenna, and $\varepsilon_{min}$=20° for the type 2 antenna.

An at least partial solution to the skew angle problem experienced with type 1 antennas is to electronically distort or rotate the asymmetric beam produced so that the longer plane of the beam is orthogonal to the arch described by the set of communication satellites. While this can reduce the amount of interference to non-target satellites, such a solution adds to the complexity of the communication system and may not be suitable for harsh operating environments (where mechanical systems can be more reliable). In addition, such a solution does not address the differences in antenna profile. Recently, phased array solutions have been provided but are, to date, prohibitively expensive for many uses. As a result, current technology provides either a wide coverage antenna with an undesirably high profile or a low profile antenna with relatively low coverage.

Thus, there is still a need for antenna that support communication over a wide range of latitudes while minimizing the antenna profile.

SUMMARY OF THE INVENTION

The inventive subject matter provides devices and systems that include a telecommunications antenna having a plurality of modular, radiating elements disposed about a perimeter of the antenna. The plurality of modular, radiating elements advantageously permits a height of the antenna to be varied depending on an airline's needs. For example, a flat antenna is often sufficient for regional airlines, which fly short routes having low latitudes. However, certain long-haul flights occur at high latitudes (e.g., above 60° N latitudes) and may require a higher antenna profile for extended coverage.

In some contemplated embodiments, the geometry of the radiating elements can be selected at installation of the antenna and remain fixed in place once selected.

In other contemplated embodiments, the geometry of the radiating elements can be varied dynamically during a flight. In this manner, the higher drag from an increased profile of an antenna can be limited only to those regions where a satellite is visible under low elevations angles, and thus a higher profile is needed. In other regions, the profile of the antenna can be reduced by adjusting an angle of the radiating elements.

The elevation angle θ provides a trade-off in the range of latitudes over which the antenna provides adequate performance and the profile height (d) of the antenna. The elevation angle θ defines a height d relative to the horizon plane.

Various objects, features, aspects and advantages of the inventive subject matter will become more apparent from the following detailed description of preferred embodiments, along with the accompanying drawing figures in which like numerals represent like components.

DETAILED DESCRIPTION

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

It should be appreciated that devices and systems of the inventive concepts described herein advantageously provide a robust and effective antenna system that permits aircraft to communicate with telecommunications satellites within their operating latitudes while minimizing the impact on aircraft performance (e.g., reduce drag from the antenna).

Figure 1:
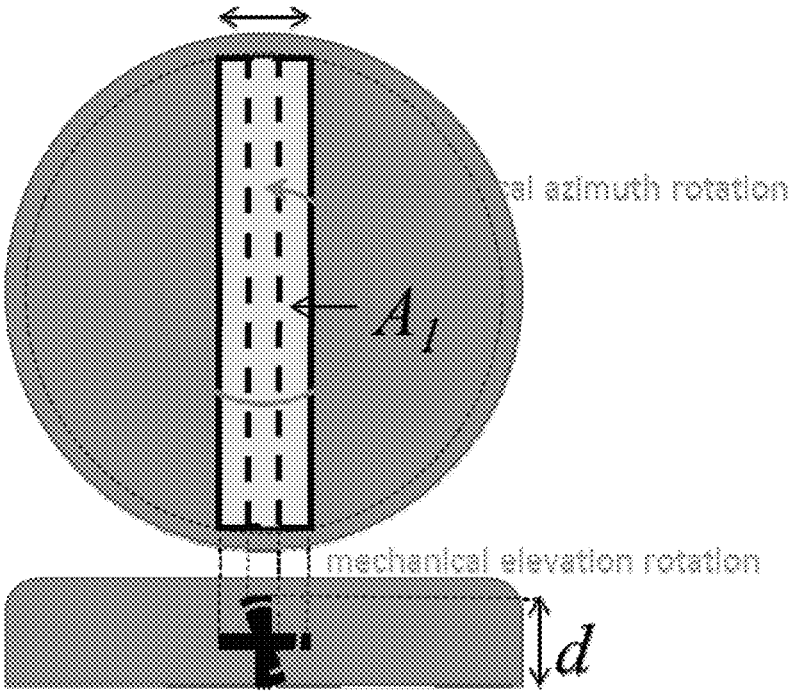
FIG. 1 depicts an exemplary type 1 antenna of the prior art.
Figure 2:
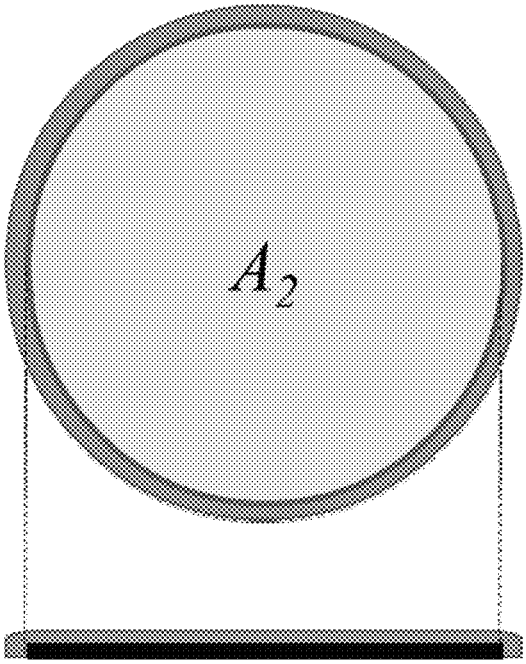
FIG. 2 depicts an exemplary type 2 antenna of the prior art.
Figure 3:
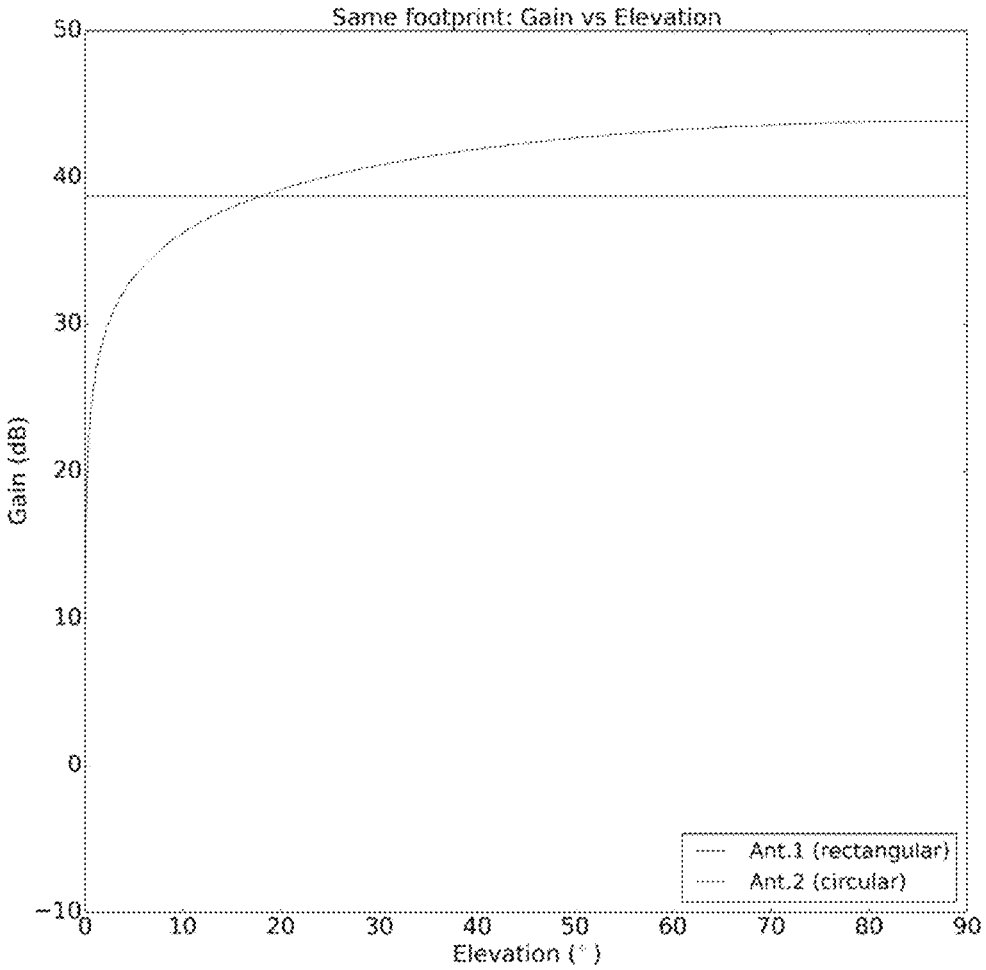
FIG. 3 depicts the relationship between antenna gain and elevation angle for two prior art antenna configurations.
Figure 4:
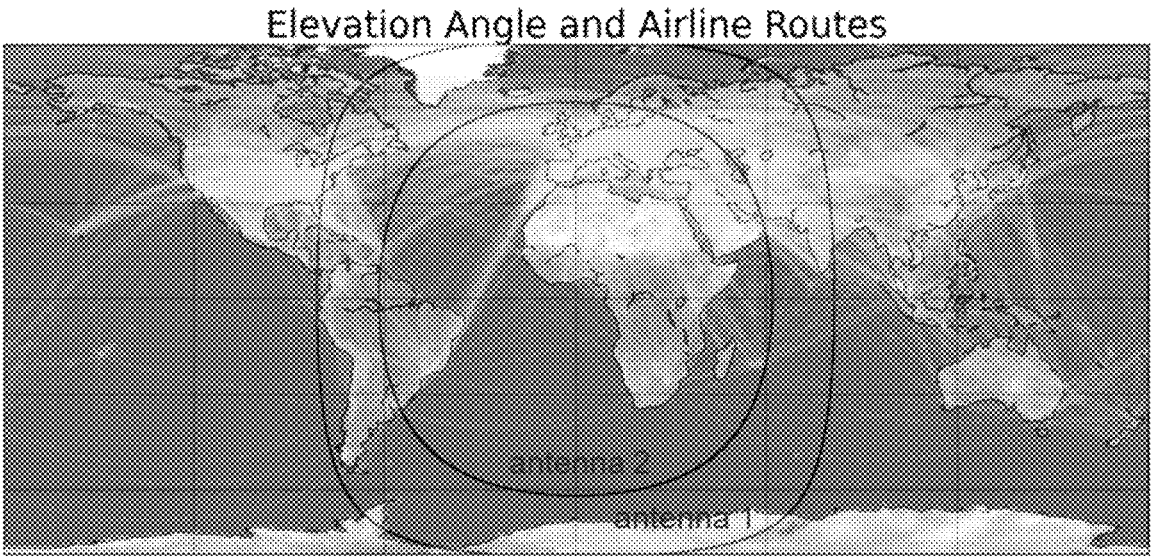
FIG. 4 depicts a mapping of airline routes overlapped with elevation angles of type 1 and type 2 antennas.
Figure 5:
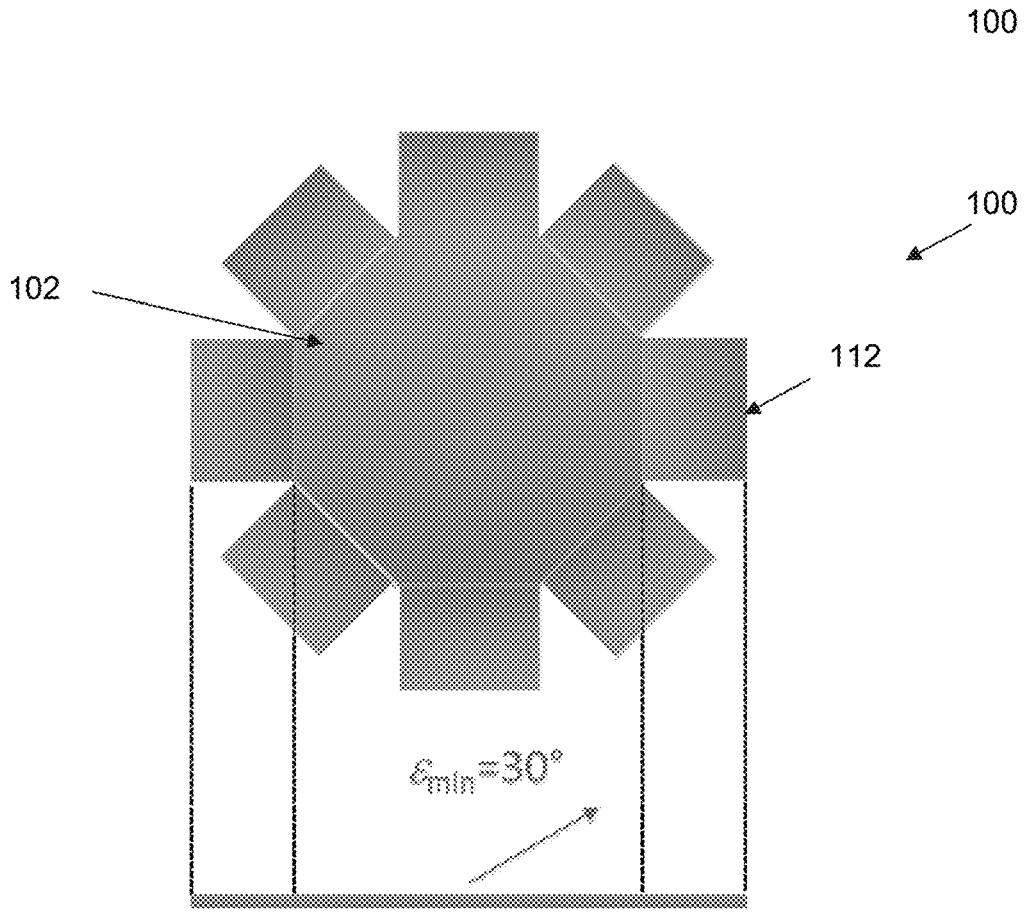
FIG. 5 depicts one embodiment of an antenna having modular, radiating elements.
Figure 6:
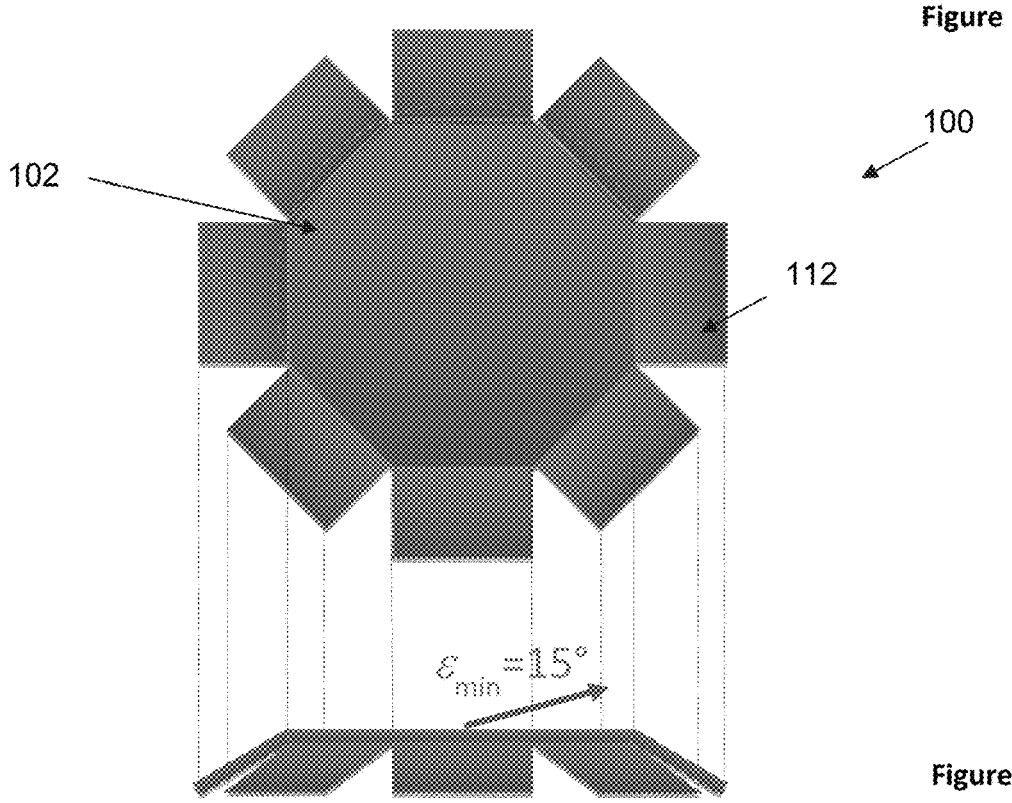
FIGS. 6-7 depict the antenna of FIG. 5 with different geometries and reduced minimum elevation angles when compared with FIG. 5.
Figure 7:
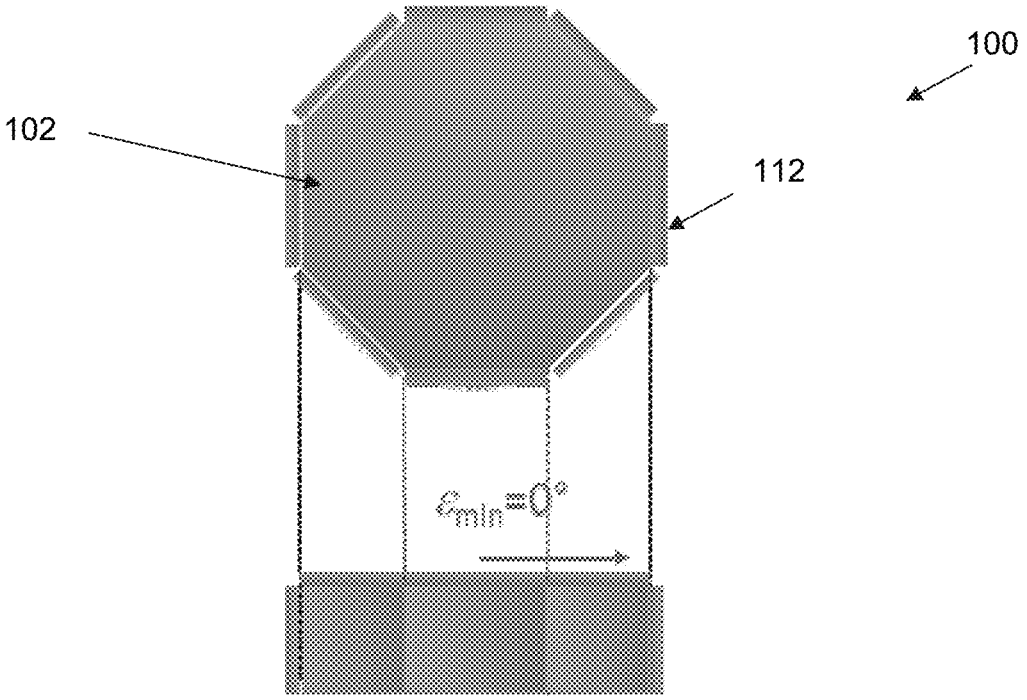

FIGS. 5-7 illustrates one embodiment of an antenna 100 suitable for use in communication between an aircraft and a communication satellite. Antenna 100 comprises a center element 102 having an octagonal shape, and a plurality of modular, radiating elements 110 (radiating modules). Preferably, the antenna's geometry is somewhat circular, as opposed to a square-shaped center element with four radiating elements.

As shown by comparing FIGS. 5-7, the modular, radiating elements 110 can be installed in, or adjusted to, different geometries (e.g. configurations shown in FIG. 5, FIG. 6, and FIG. 7) to reach different minimum required elevation angles ($e_{min}$). Each of the modular, radiating elements 110 are fed electronically or with a suited beam forming network, to support the selected geometry. The specific number of radiating elements 110 and the overall shape of the center element 102 can be varied without departing from the scope of the invention discussed herein.

It is further contemplated that each of the modular, radiating elements 110 comprise transmitting and receiving elements, which are interlaced/integrated in each radiating element 110. Preferably, the transmitting and receiving elements are disposed on a single antenna aperture with a circular symmetry, and integrated uniformly in each radiating element 110.

The geometry of the modular, radiating elements 110 is selected such that the antenna 100 has a minimum effective area (and thus a guaranteed minimum antenna gain) in the required minimum elevation towards a desired satellite (e.g., the configuration in FIG. 7 has $e_{min}=0°$).

It is contemplated that the specific geometry of the modular, radiating elements 110 can be selected at installation of the antenna 100 and remain fixed, based on a decision to have broader coverage at the price of higher profile, and thus additional drag. This is based on the specific tradeoff between profile height of the antenna 100 and achievable latitudes.

However, it is preferred that the specific geometry of the modular, radiating elements 110 can be adjusted dynamically during a flight. In such configuration, the additional drag from a higher antenna profile can be reduced to only occur in those regions of flight where a satellite is visible under low elevations angles, and thus a higher antenna profile is needed.

To vary the geometry of the modular, radiating elements 110, only a single linear movement in height of the center element 102 is required. For example, it is contemplated that each of the modular, radiating elements 110, and preferably a first end of each element 110, can be coupled to the center element 102. In such embodiments, a mechanical riser could be used to raise and lower the center element 102, which in turn causes the modular, radiating elements 110 to change in geometry and move with the movement of the center element 102. A lower portion of each of the element 110 can slide or move horizontally as a function of an increase or decrease in height of an upper portion of each element 110, which is coupled to the center element 102. It is also contemplated that the lower portion can be coupled to a lower surface of antenna, and could in some embodiments include one or more rollers to reduce friction between the surfaces.

When a profile of the antenna 100 is increased (e.g., center element 102 is lifted), the modular elements 110 create a larger effective area towards lower elevation angles. In such configurations, the beam forming network must be configured to adapt to the current geometry, such that the signals feeding the different radiating elements 110 have proper delays or a suitable difference in phase. It is contemplated that the antenna 100 should be lifted only where a satellite is visible under low elevations angles, and thus a higher profile is needed.

Advantageously, by utilizing an antenna with modular, radiating elements 110 that can be changed dynamically during a flight, the antenna 100 can have (i) maximum achievable latitudes equivalent to a type 1 antenna (e.g. higher availability in transatlantic routes), (ii) higher antenna gain at lower latitudes that can be exploited to provide higher throughputs at lower latitudes, and (iii) no "skew angle" problem at equator because the beam is narrow in elevation.

Figure 8:
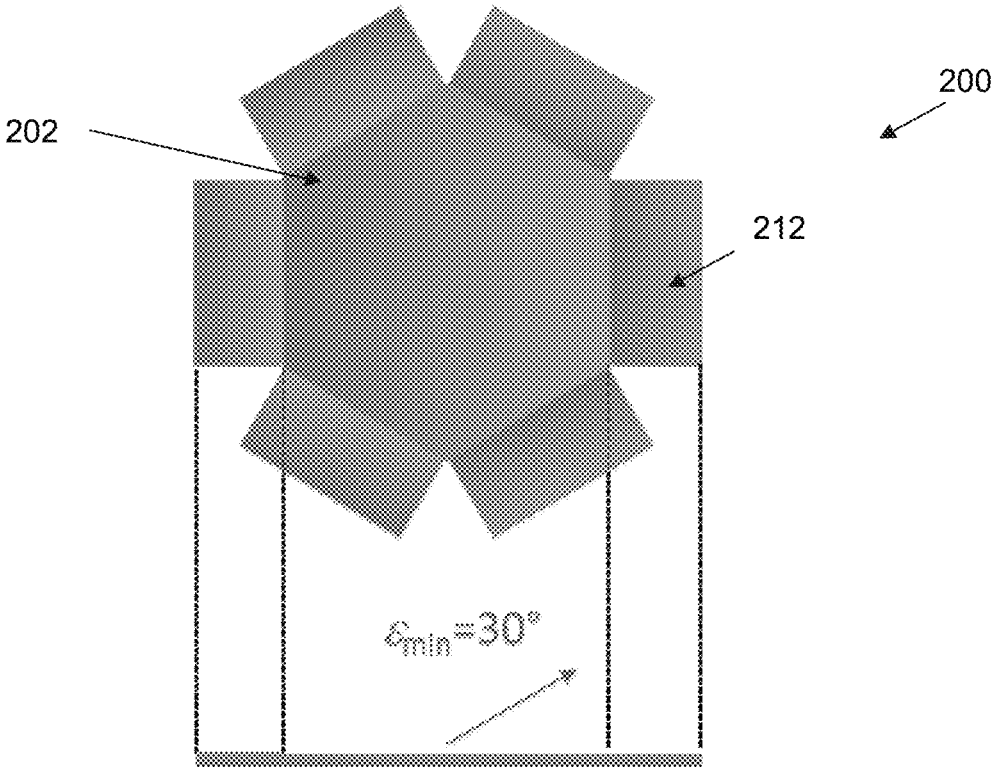
FIG. 8 depicts another embodiment of an antenna having modular, radiating elements.
Figure 9:
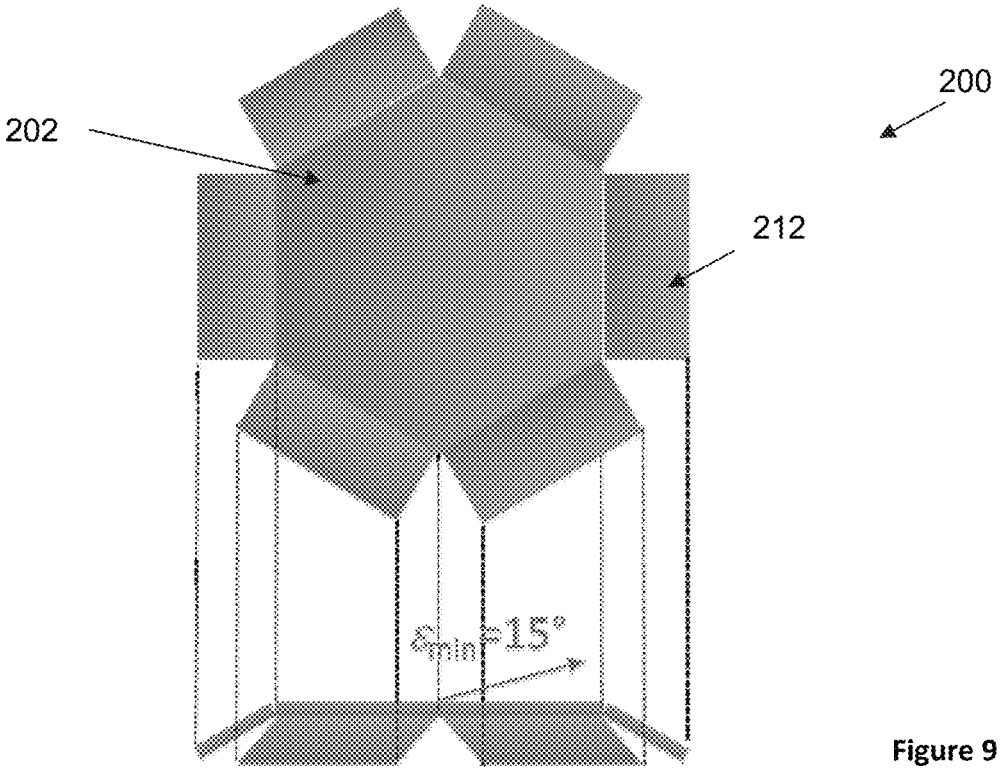
FIGS. 9-10 depict the antenna of FIG. 8 with different geometries and reduced minimum elevation angles when compared with FIG. 8.
Figure 10:
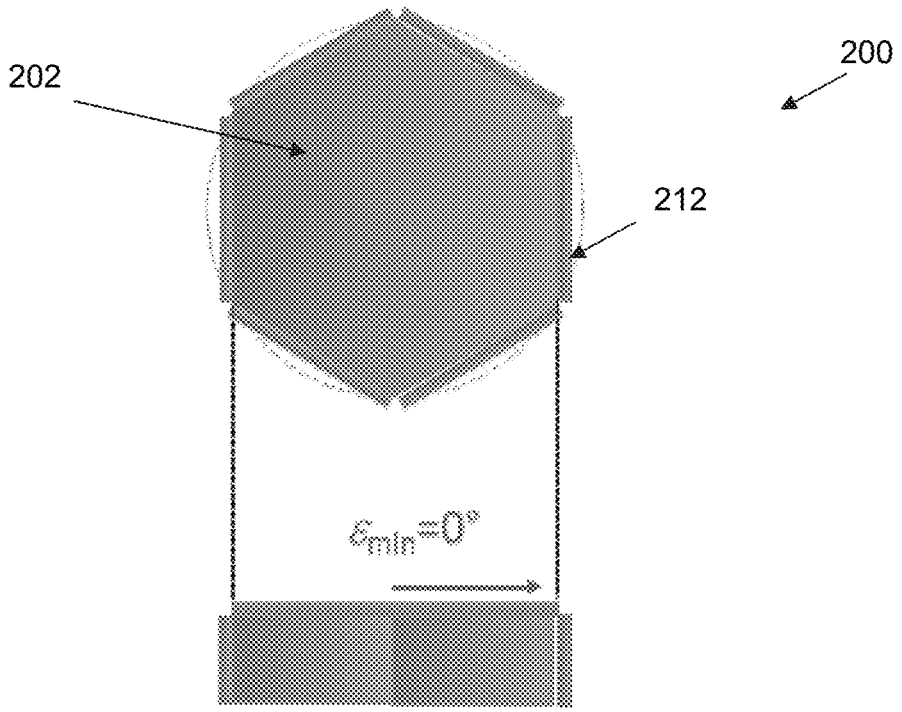

FIGS. 8-10 illustrates another embodiment of an antenna 200 comprising a center element 202 having a hexagonal shape, and a plurality of modular, radiating elements 210 (radiating modules) disposed about the center element 202, and preferably coupled thereto. As shown by comparing FIGS. 8-10, the modular, radiating elements 210 can also be installed in, or adjusted to, different geometries (e.g. configurations shown in FIG. 8, FIG. 9, and FIG. 10) to reach different minimum required elevation angles ($e_{min}$). Each of the modular, radiating elements 210 are fed electronically or with a suited beam forming network, to support the selected geometry.

While the number of modular, radiating elements 210 is less than that shown in FIGS. 5-7, the function and description above with respect to antenna 100 of FIGS. 5-7 applies equally to antenna 200 shown in FIGS. 8-10.

Figure 11:
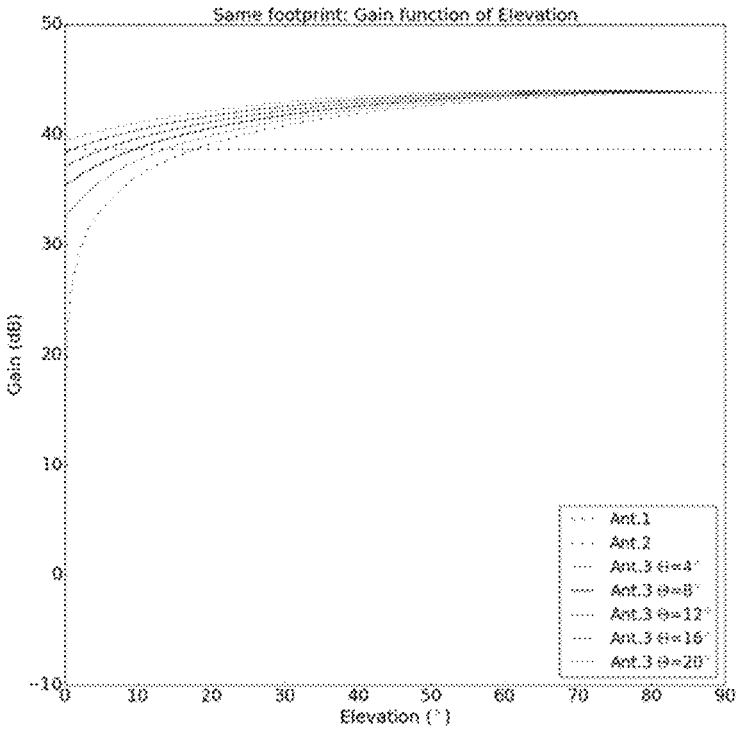
FIG. 11 depicts a chart of gain as a function of elevation comparing how the prior art antennas compare with the antenna depicted in FIG. 5 in different configurations.

FIG. 11 depicts gain as a function of elevation, and provides an qualitative comparison between the type 1 and type 2 antennas (shown in dashed lines), and the antenna 100 shown in FIGS. 5-7 in different configurations (i.e. different inclination of the lateral radiating elements 110, and thus different heights d). For a static (fixed) installation, antenna 100 achieves the best performance when compared with the type 1 and type 2 antennas, across all selected elevation angles for which the needed "price" for the profile height is paid. For this comparison, all antennas have the same footprint. As shown, antennas of the inventive concept consistently show improved performance over prior art designs.

For a dynamic installation where the geometry of antenna 100 varies during flight, antenna 100 functions at all elevation angles (down to $\varepsilon_{min}=0°$), always with the lowest needed profile height. This means that, if a radome is not installed, drag from the antenna 100 can be minimized.

While values for θ are shown as ranging from 4° to 20°, it should be appreciated that suitable angles for θ can range from less than 1°, about 1°, about 2°, about 3°, about 4°, about 5°, about 6°, about 7°, about 8°, about 9°, about 10°, about 12°, about 14°, about 16°, about 18°, and about 20°.

Unless the context dictates the contrary, all ranges set forth herein should be interpreted as being inclusive of their endpoints, and open-ended ranges should be interpreted to include only commercially practical values. Similarly, all lists of values should be considered as inclusive of intermediate values unless the context indicates the contrary. The recitation of ranges of values herein is merely intended to serve as a shorthand method of referring individually to each separate value falling within the range. Unless otherwise indicated herein, each individual value with a range is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Figure 12:
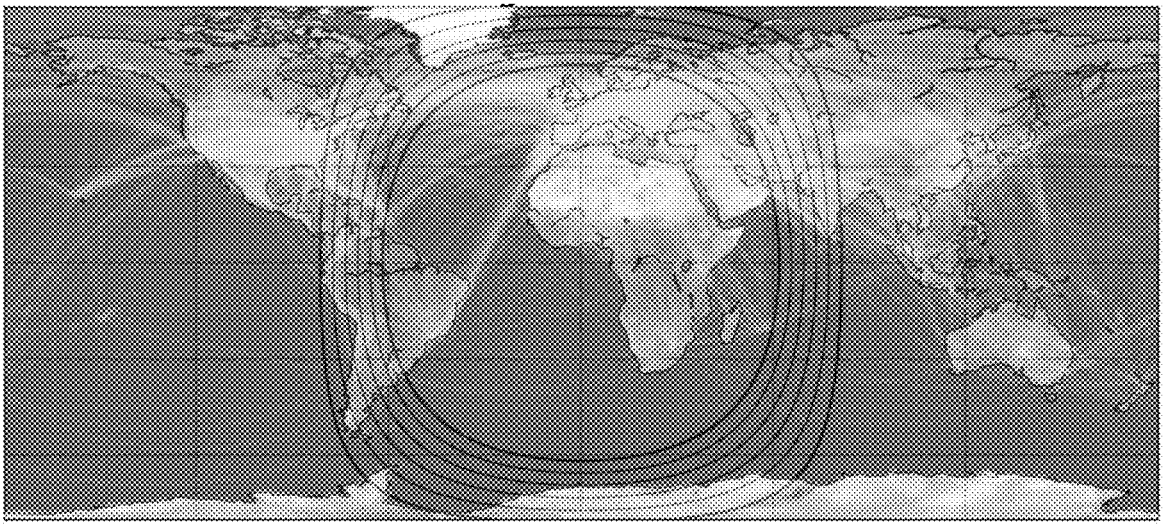
FIG. 12 depicts a mapping of airline routes overlapped with elevation angles of type 1 and type 2 antennas, and the antenna depicted in FIG. 5 in different configurations.

FIG. 12 depicts a world map with airplane routes shown based on that provided by openflights.org. The elevation angles of the type 1 and type 2 antennas, and antenna 100 are overlaid, and shown as contours on the map with the depicted elevation angles of antenna 100 being $e_{min}=0°$, 4°, 8°, 12°, 16°, 20°. The innermost contour depicted is $e_{min}=0°$, the next contour moving outwards depicts $e_{min}=4°$, the next contour moving outwards depicts $e_{min}=8°$, the next contour moving outwards depicts $e_{min}=12°$, the next contour moving outwards depicts $e_{min}=16°$, and the outermost contour depicts $e_{min}=20°$. As shown, the elevation angle θ impacts the latitudes at which an aircraft-mounted antenna can be used for satellite communication.

While values for θ are shown as ranging from 4° to 20°, it should be appreciated that suitable angles for θ can range from less than 1°, about 1°, about 2°, about 3°, about 4°, about 5°, about 6°, about 7°, about 8°, about 9°, about 10°, about 12°, about 14°, about 16°, about 18°, and about 20°.

Figure 13:
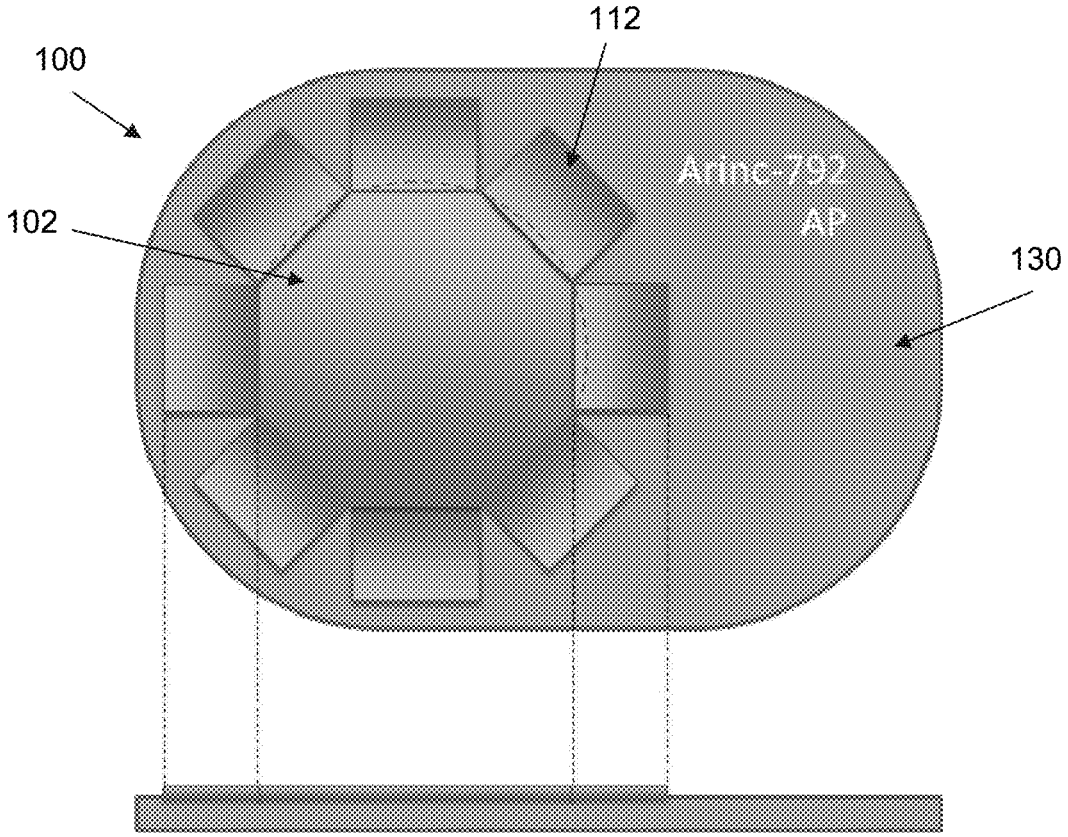
FIGS. 13-15 depict another embodiment of an antenna disposed on an adapter plate, shown with different geometries.
Figure 14:
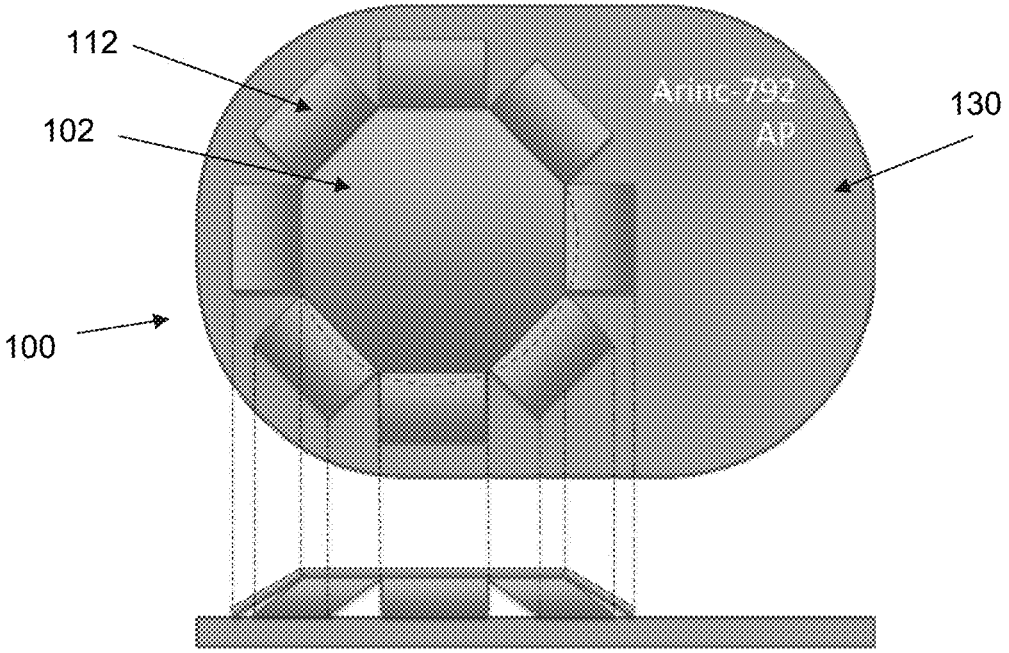
Figure 15:
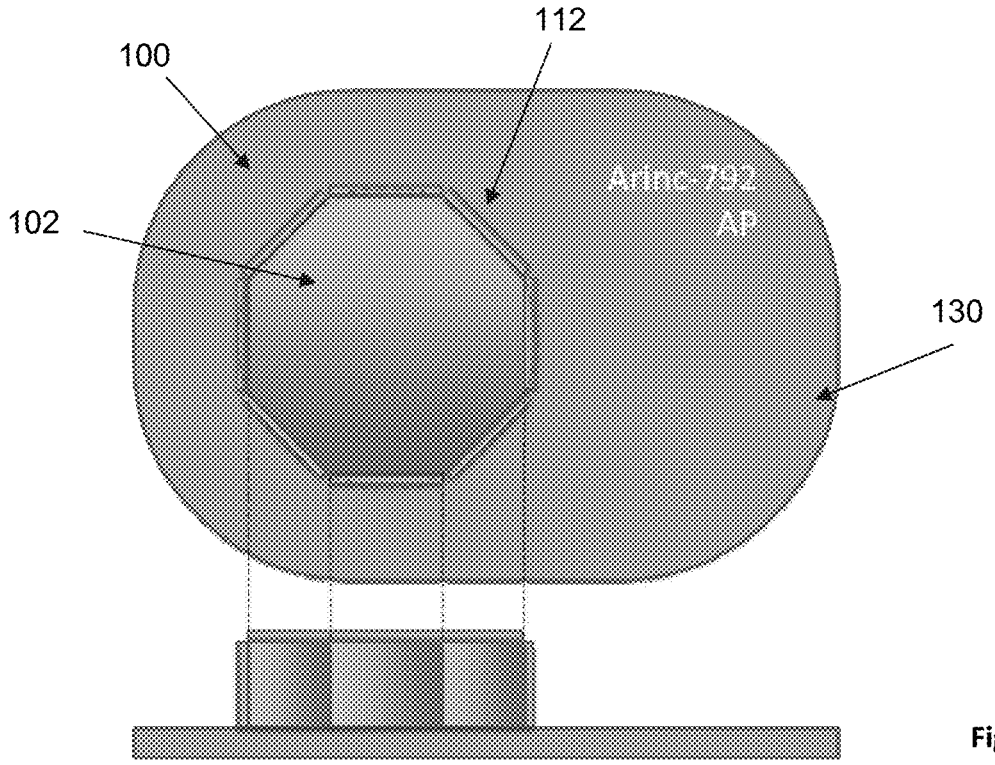

FIGS. 13-15 illustrates antenna 100 being placed on an adapter plate 130, here an ARINC-792 adapter plate. In such embodiments, it is contemplated that the adapter plate 130 can support a riser or other mechanism required to permit raising and lowering of center element 102. It is further contemplated that a bottom portion of each element 110 can be coupled to the adapter plate 130, such that the bottom portion of each element 110 remains coupled to the adapter plate 130 even when the geometry of the antenna 100 is changed. Thus, the bottom portions of each element 110 can move toward or away from the center element 102 as the element 102 is raised or lowered.

Figure 16:
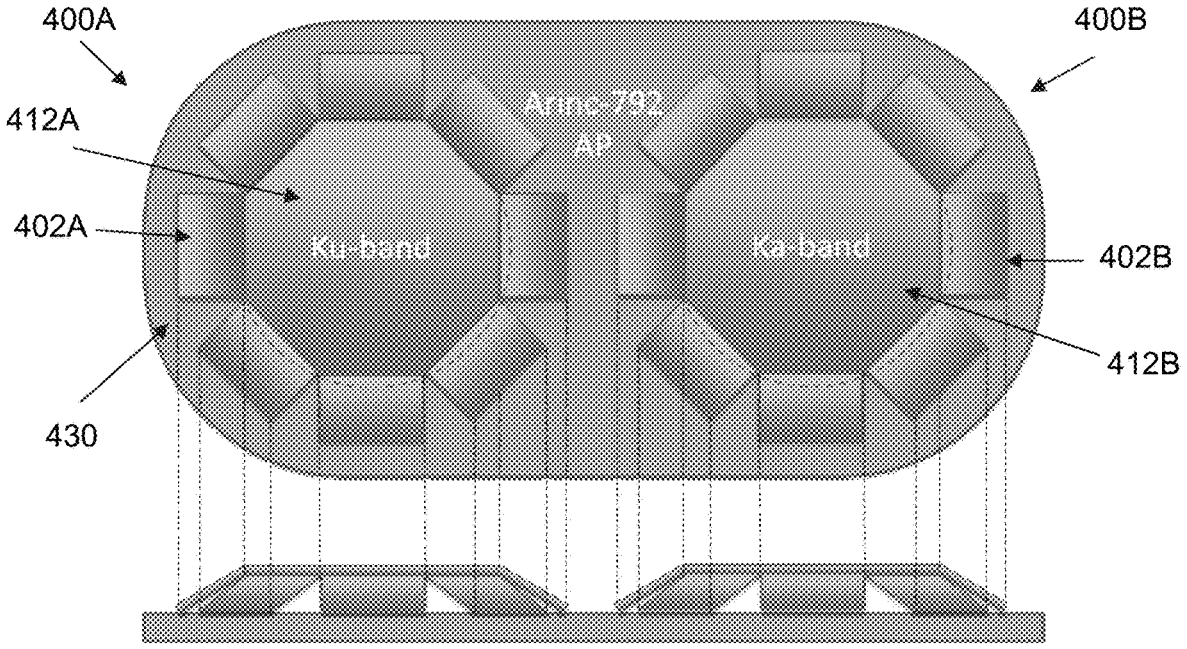
FIG. 16 depicts how two antennas can be disposed on a single adapter plate.

FIG. 16 illustrates an adapter plate 430 configured to support two antennas 400A, 400B. This advantageously permits the two antennas 400A, 400B to be disposed on an aircraft, which could be used, for example, to support both Ku and Ka bands. The first antenna 400A preferably comprises a plurality of modular, radiating elements 402A (radiating modules) disposed about the center element 412A, and preferably coupled thereto. The second antenna 400B preferably comprises a second plurality of modular, radiating elements 402B (radiating modules) disposed about the second center element 412B, and preferably coupled thereto.

It is contemplated that the modular, radiating elements of each of the two antennas 400A, 400B can also be installed in, or adjusted to, different geometries, which may or may not be varied during flight, to reach different minimum required elevation angles ($e_{min}$). Each of the modular, radiating elements of the two antennas 400A, 400B can be fed electronically or with a suited beam forming network, to support the selected geometry.

Transmitting and receiving elements can be interlaced/integrated in each of the radiating modules 412A, 412B of the two antennas 400A, 400B, preferably on a single antenna aperture with a circular symmetry. In this manner, it is possible to accommodate both antennas 400A, 400B on the adapter plate 430, here an ARINC-792 adapter plate: antenna 400A for Ku band (both transmitting and receiving) and antenna 400B for Ka-band (both transmitting and receiving).

In each of the configurations described above, it is preferred that a radome is not included on the antennas. Instead, a protection layer can be placed over the antenna, which allows the antenna to exploit the reduction in drag when an antenna is changed from having a high profile to a lower profile, for example.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A telecommunications antenna for an aircraft, comprising:

a plurality of modular, radiating elements disposed about and coupled to a center element;

wherein each of the plurality of modular, radiating elements comprises transmitting and receiving elements;

wherein the antenna is configured such that a geometry of the modular, radiating elements is variable during flight which in turn varies a profile of the antenna; and a height adjustment mechanism configured to raise or lower the center element, wherein adjustment to a height of the center element varies the geometry of the modular, radiating elements.

2. The telecommunications antenna of claim 1, wherein each of the plurality of modular, radiating elements is fed electronically or with a suited beam forming network.

3. The telecommunications antenna of claim 1, wherein the transmitting and receiving elements are interlaced or integrated in each radiating element.

4. The telecommunications antenna of claim 3, wherein the transmitting and receiving elements are disposed on a single antenna aperture with a circular symmetry, and integrated uniformly in each radiating element.

5. The telecommunications antenna of claim 1, further comprising an adapter plate, and wherein the center element and plurality of modular, radiating elements are each coupled to the adapter plate.

6. The telecommunications antenna of claim 1, wherein the antenna lacks a radome covering the plurality of modular, radiating elements and the center element, such that the profile of the antenna can be adjusted.

7. The telecommunications antenna of claim 1, wherein the antenna has a minimum elevation angle of between 0° to 20°.

8. A telecommunications system for an aircraft, comprising:

an adapter plate;

a first antenna disposed on the adapter plate and comprising:

a first plurality of modular, radiating elements disposed about and coupled to a first center element;

wherein each of the first plurality of modular, radiating elements comprises transmitting and receiving elements; and a height adjustment mechanism configured to raise or lower the first center element, and wherein adjustment to a height of the first center element varies the geometry of the first plurality of modular, radiating elements;

a second antenna disposed on the adapter plate and comprising:

a second plurality of modular, radiating elements disposed about and coupled to a second center element; and wherein each of the second plurality of modular, radiating elements comprises transmitting and receiving elements; and wherein the first and second antennas are each configured such that a geometry of the first and second pluralities of modular, radiating elements, respectively, is variable during flight.

9. The telecommunications system of claim 8, wherein each of the first and second pluralities of modular, radiating elements is fed electronically or with a suited beam forming network.

10. The telecommunications system of claim 8, wherein the transmitting and receiving elements of the first plurality are interlaced or integrated in each radiating element.

11. The telecommunications system of claim 10, wherein the transmitting and receiving elements of the first plurality are disposed on a single antenna aperture with a circular symmetry, and integrated uniformly in each radiating element.

12. The telecommunications system of claim 8, wherein the first and second center elements and each of the modular, radiating elements of the first and second pluralities are coupled to the adapter plate.

13. The telecommunications system of claim 8, wherein the first and second antennas lack a radome covering the first and second pluralities of modular, radiating elements and the first and second center elements, such that the profile of one or both of the first and second antennas can be adjusted.

14. The telecommunications antenna of claim 8, wherein the first and second antennas each has a minimum elevation angle of between 0° to 20°.

* * * * *